US005416284A

United States Patent [19]

Steele et al.

[11] Patent Number: 5,416,284

[45] Date of Patent: May 16, 1995

[54] SPEAKER ENCLOSURES

[75] Inventors: Arthur G. Steele, Sunderland; Karl von Kries, Northampton, both of Mass.

[73] Assignee: Hardigg Industries Inc., South Deerfield, Mass.

[21] Appl. No.: 201,760

[22] Filed: Feb. 25, 1994

[51] Int. Cl.[6] ..... A47B 81/06

[52] U.S. Cl. ..... 181/199; 220/4.02

[58] Field of Search ..... 181/150, 199, 141, 198; 381/88, 189; 220/4.02, 4.21, 4.22, 324

[56] References Cited

U.S. PATENT DOCUMENTS

| | | | |
|---|---|---|---|
| 1,613,993 | 1/1927 | Griffiths | 181/180 |
| 2,036,832 | 4/1936 | Scheldorf | 181/199 |
| 2,835,335 | 5/1958 | Glassey | 181/152 |
| 3,464,579 | 9/1969 | Asenbauer | 220/4.21 |
| 3,931,867 | 1/1976 | Janszen | 181/148 |
| 4,082,159 | 4/1978 | Petty | 181/153 |
| 4,284,202 | 8/1981 | Barstow, Jr. | 220/4.21 |
| 4,310,065 | 1/1982 | Kayman | 181/159 |
| 4,314,620 | 2/1982 | Gollehon | 181/152 |
| 4,433,750 | 2/1984 | Neese | 181/159 |
| 4,908,601 | 3/1990 | Howze | 181/152 |
| 4,934,480 | 6/1990 | Gaté | 181/150 |
| 4,949,386 | 8/1990 | Hill | 181/199 |
| 5,117,938 | 6/1992 | Whanhaeng | 181/148 |

*Primary Examiner*—Khanh Dang

*Attorney, Agent, or Firm*—Fishman, Dionne & Cantor

[57] ABSTRACT

Molded enclosures for audio speakers and the like comprising a molded base and a releasably-attachable molded cover wherein said cover may also be attached to the rear of said base for stabilizing said enclosure and supporting an outwardly-extending stabilizing fin for attachment to another enclosure stacked thereon.

3 Claims, 1 Drawing Sheet

SPEAKER ENCLOSURES

BACKGROUND OF THE INVENTION

This invention relates to the field of acoustic speakers and more particularly to speaker enclosures or cabinets formed using a plastic rotomolding process.

Traditionally, speaker enclosures have been made from several individual pieces to form enclosures of varying dimensions and shapes. In such speaker enclosures, the pieces may be made from wood, particle board, chip board, some metals and plastics. In the case of plastic enclosures, one of two methods of fabrication is usually employed. In the first method, individual pieces of plastic in thick sheet form are fastened together by known means and in the second method, the main walls of the speaker enclosure are molded using rotational or injection molding techniques. In each method, the enclosure is generally a five-sided cuboid with the sixth side left open for the mounting of speakers and grills therein. Said speakers generally do not have means thereon for stabilizing said speakers in the event two or more enclosures are stacked one on top of the other or side by side. Consequently, said speaker enclosures, when so stacked or combined, may fall or tip over during use.

SUMMARY OF THE INVENTION

The above-discussed and other drawbacks and disadvantages of prior art molded speaker enclosures may be overcome or alleviated by the rotomolded speaker enclosures of the present invention wherein said speaker enclosures are provided with stabilizing means.

The speaker enclosures of the present invention are generally produced using basic rotomolding processes such as described in U.S. Pat. No. 4,284,202 which is incorporated herein by reference. Said speaker enclosures include a five-side speaker box, speaker and grill members in said box and a shallow lid or cover which is releasably affixed to said speaker box for covering said speakers and grill during transport and storage.

As a feature of the present invention, said speaker enclosures are provided with stabilizing means for permitting said enclosures to be stacked on top of each other or combined in side-by-side relationship.

As a further feature of the present invention, said speaker enclosures are provided with means for attaching the lid or cover to the rear of the enclosure during use which gives added stability to the enclosure.

The forgoing and other objects, features and advantages of the present invention will become more apparent in light of the following detailed description of exemplary embodiments thereof as illustrated in the accompanying drawing.

DETAILED DESCRIPTION OF THE PREFERRED EMBODIMENT

Figure 1:
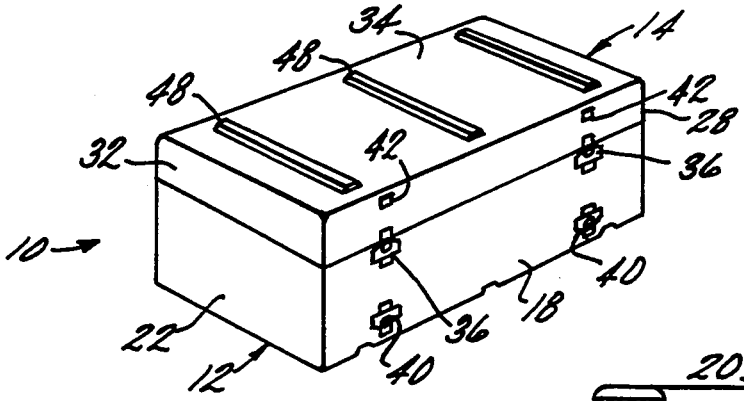
FIG. 1 is a perspective view of the speaker enclosure of the present invention.
Figure 2:
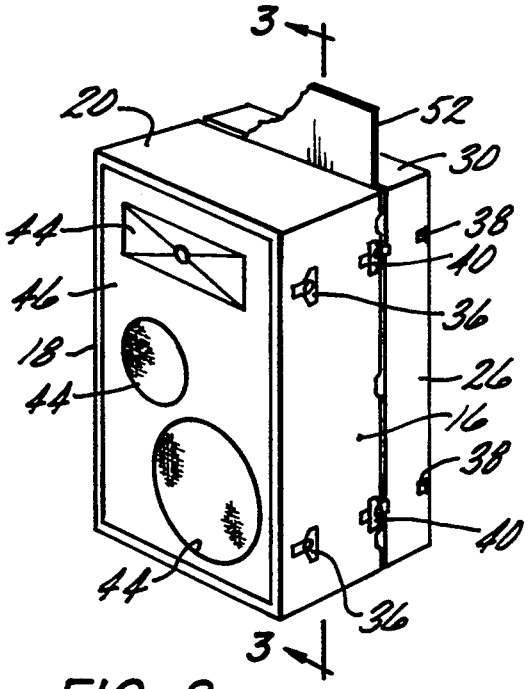
FIG. 2 is a perspective view of the speaker enclosures of the present invention with the cover or lid attached to the rear of the enclosure.

As shown in FIGS. 1 and 2, the speaker enclosure of the present invention is indicated at 10. Said enclosure 10 is comprised of a base unit 12 and a removable cover or lid 14. As shown, the base unit 12 is basically a box comprising 2 side walls 16 and 18, a top wall 20, a bottom wall 22 and a rear wall 24. The cover or lid 14 is similar to the base unit 12 in that it has sides 26 and 28, a top wall 30, a bottom wall 32 and a rear wall 34. As shown, the side walls 16 and 18 are provided with a first set of latches 36 which are engagable with a set of strikes 38 disposed on the sides of the cover or lid 14 for releasably holding said cover 14 in closed relationship with the base unit 12. As also shown, said base unit 12 is also provided with a second set of latches 40 adjacent the rear of said enclosure 10. Said latches 40 are engagable with a second set of strikes disposed on the side walls 26 and 28 of the cover or lid 14 adjacent the front surface 34. The purpose of said second set of strikes and latches will be explained below.

As best seen in FIG. 2, the enclosure 10 is provided with a speaker and grill system which may include one or more audio speakers 44 attached to a grill 46 which is mounted in a front wall of said speaker enclosure 10 by known means.

Figure 3:
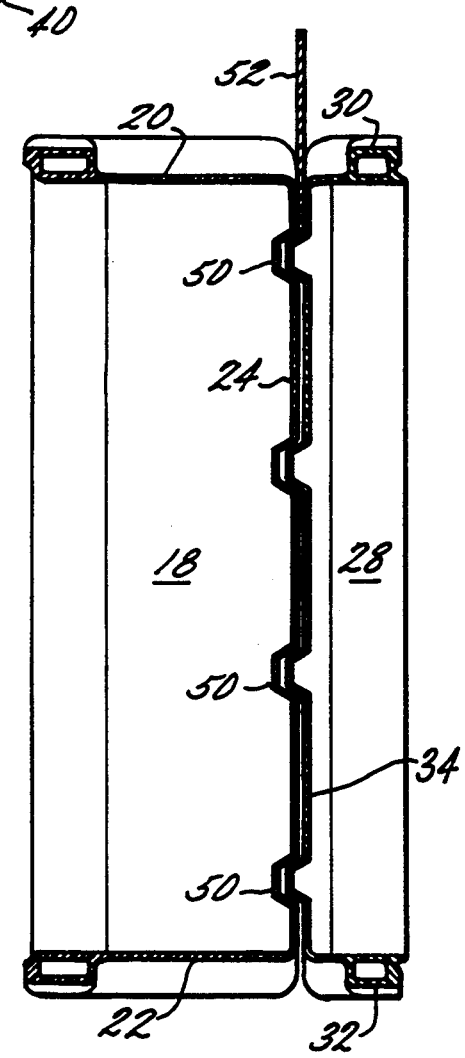
FIG. 3 is a section view taken along the line 3—3 of FIG. 2.

As will be appreciated by those skilled in the art, the speaker enclosure 10 with speakers 44 disposed therein are protected during transport and storage by latching the cover or lid 14 to the base unit 12 with latches 36 and strikes 38. When said enclosures are placed in an "operation mode", the cover 14 is removed from the front of the base unit 12 and latched to the rear of said unit 12 as shown in FIGS. 2 and 3. In this mode, latches 40 on the base unit 12 are attached to strikes 42 on the lid 14 so that the rear wall 34 of the lid 14 and the rear wall 24 of the base are adjacent one another. As also shown, the rear wall 34 of the lid 14 is provided with a plurality of convex ribs 48, while the rear wall 24 of the base unit 12 is provided with corresponding concave ribs 50. Said ribs 48 and 50, which are integrally molded with the parts, provide strength to each part and act as positioning means between the lid 14 and the base unit 12. When the lid 14 and the base unit 12 are disposed in this relationship, the natural drafts on the lid 14 and the base unit 12 caused by the molding process provide very stable edge-only contact with the surface on which they are placed.

Figure 4:
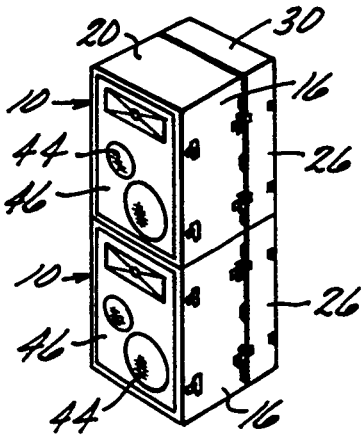
FIG. 4 is a perspective view of two speaker enclosures stacked one on top of the other.

As shown in FIGS. 2 and 3, stacking stabilizing means in the form of a fin or plate 52 is employed when one wishes to stack one or more enclosures on top of each other during operation of said speakers. Said fin or plate 52 is preferably a flat thin strip of metal such as aluminum which is inserted between the rear wall 34 of the lid 14 and the rear wall 24 of the base 12 as they are being latched together as depicted. In that said fin 52 extends above the upper walls 20 and 30 of the base 12 and lid 14, it may also be inserted between the base 12 and lid 14 of a second speaker enclosure placed on top of the first speaker enclosure. This stacking of enclosure units is shown in FIG. 4. As will be recognized by those skilled in the art, the fin 52 may also be employed to stabilize speaker enclosures in side by side relationship as well as in stacked relationship.

While the present invention has been disclosed in connection with a preferred embodiment thereof, it should be appreciated that there may be other embodiments which fall within the spirit and scope of the present invention as defined by the appended claims.

What is claimed is:

1. A speakers enclosure comprising:

a base unit for holding said speakers, said base unit having a front wall for supporting said speakers, a top wall, a bottom wall, a pair of side walls and a rear wall;

a cover for covering said speakers, said cover having a top wall, a bottom wall, a pair of side walls and a rear wall, said cover releasably covers the front wall of said base unit;

first and second sets of latch means disposed on said pair of side walls of said base unit;

first and second sets of strike means disposed on said pair of side walls of said cover;

said first set of latch means being engagable with said first set of strike means when said cover covers said speakers;

said second set of latch means being engagable with said second set of strike means when said rear wall of said base unit is disposed against the rear wall of said cover; and stacking stabilization means disposed between said rear walls of said cover and said base unit and extending outwardly therefrom.

2. The enclosure of claim 1 wherein said stacking stabilization means comprises a flat plate having a portion thereof pinned between the rear walls of said base unit and said cover.

3. The enclosure of claim 2 wherein said flat plate is an aluminum plate.

* * * * *